US005690026A

United States Patent [19]

Thudium et al.

[11] Patent Number: 5,690,026

[45] Date of Patent: Nov. 25, 1997

[54] ARRANGEMENT FOR TRANSFERRING WORKPIECES THROUGH A SUCCESSION OF MACHINING STATIONS

[75] Inventors: Karl Thudium, Waeschenbeuren; Walter Rieger, Goeppingen; Andreas Dangelmayr, Ottenbach, all of Germany

[73] Assignee: Schuler Pressen GmbH & Co., Germany

[21] Appl. No.: 605,663

[22] Filed: Feb. 22, 1996

[30] Foreign Application Priority Data

Feb. 22, 1995 [DE] Germany ..... 195 06 077.6

[51] Int. Cl.[6] ..... B30B 15/30; B65G 25/00; B21D 43/05

[52] U.S. Cl. ..... 100/207; 72/405.11; 72/405.16; 198/621.1; 414/751

[58] Field of Search ..... 100/207, 215; 72/405.09–405.16; 198/621.1–621.4; 414/751

[56] References Cited

U.S. PATENT DOCUMENTS 3,754,667 8/1973 Storch ..... 414/751
4,655,097 4/1987 Suzuki ..... 72/405.11
4,966,274 10/1990 Willenbrock et al. ..... 414/751
5,473,927 12/1995 Brandstetter et al. ..... 72/405.14
5,566,814 10/1996 Hofele ..... 414/751

*Primary Examiner*—Stephen F. Gerrity
*Attorney, Agent, or Firm*—Evenson, McKeown, Edwards & Lenahan, P.L.L.C.

[57] ABSTRACT

An arrangement is used for transferring workpieces through a succession of machining stations of a press, a simulator or similar machining or tool-setting machine. Two parallel transport rails are spaced at a distance from one another and can be moved by motors horizontally in their longitudinal direction, vertically up and down and optionally horizontally toward one another. The motors are arranged on one traverse respectively, the transport rail being hinged to the traverse. Between the transport rails and the motors arranged on the traverse, a compensating guide is provided for the horizontal movement of the transport rails. The compensating guide has at least two struts and a double-armed lug with three hinge points, each of the struts being mounted on the traverse side in a hinged manner at one point respectively. The other end of the struts is in each case mounted on one of the hinge points of the double-armed lug, the third hinge point of the double-armed lug being disposed on the transport rail in a hinged manner.

3 Claims, 3 Drawing Sheets

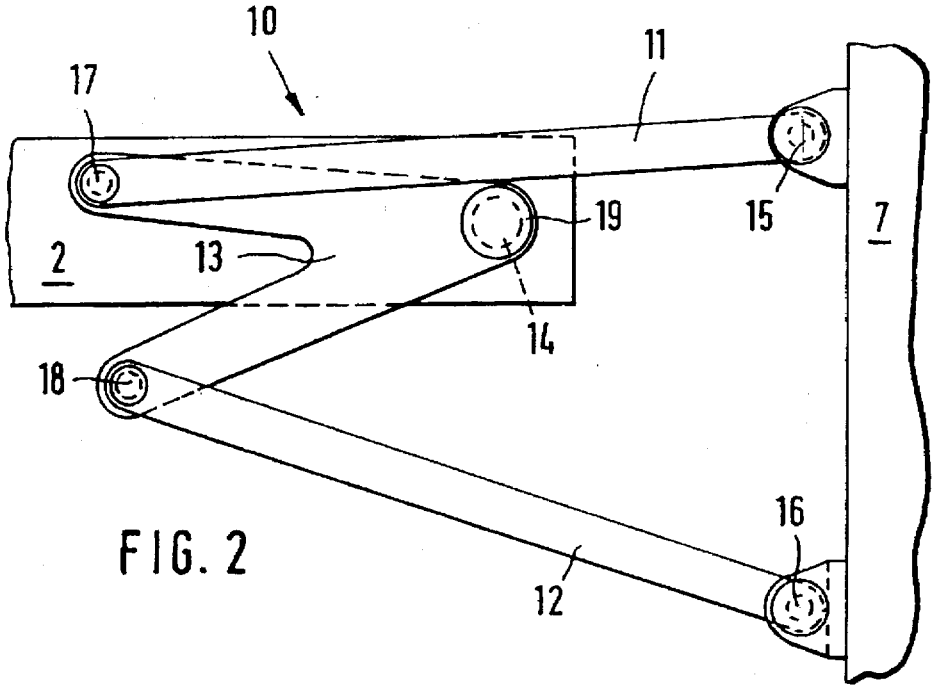
FIG. 2
FIG. 3
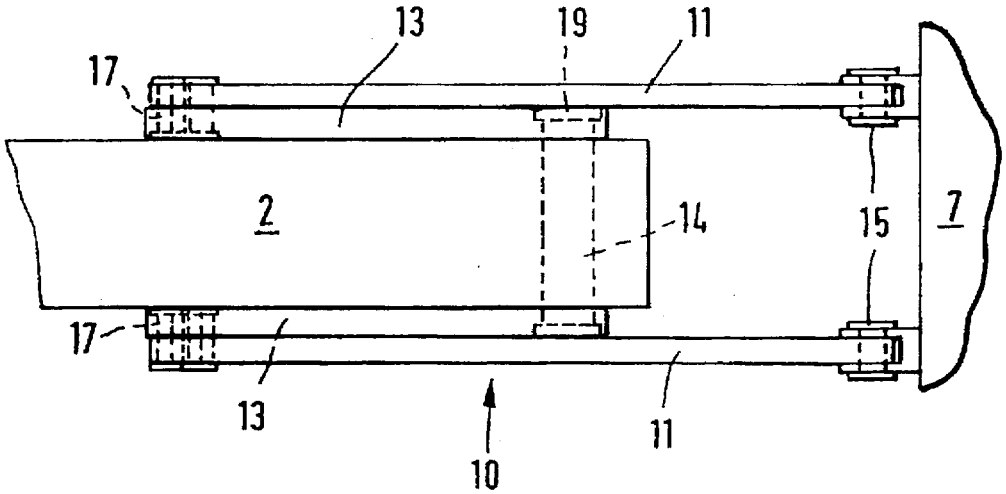

ARRANGEMENT FOR TRANSFERRING WORKPIECES THROUGH A SUCCESSION OF MACHINING STATIONS

CROSS-REFERENCE TO RELATED APPLICATION

This application is related to application Ser. No. 08/605,638 filed on Feb. 22, 1996 in the name of Karl THUDIUM et al. for ARRANGEMENT FOR TRANSFERRING WORKPIECES THROUGH A SUCCESSION OF MACHINING STATIONS.

BACKGROUND AND SUMMARY OF THE INVENTION

The present invention relates to an arrangement for transferring workpieces through a succession of machining stations of a press, a simulator or similar machining or tool-setting machine, and more particularly, to an arrangement comprising two spaced parallel transport rails and motors for moving the transport rails at least one of horizontally in a longitudinal direction thereof, vertically up and down and horizontally toward one another, the motors being arranged on one traverse respectively, and the transport rails each being hinged to the traverse.

Transfer arrangements of this type are used in presses, transfer presses, press lines, but also in simulators for transferring workpieces; in the latter application, for tooling a press.

In this case, a separate control of the transport rails is required in two or three axes.

In practice, an arrangement is known in which the moving drive of the transport rails takes place in their longitudinal direction by at least one motor which acts directly, but when a transmission is used, indirectly, upon a gear wheel. When a toothed belt is used, the at least one motor acts on a deflection wheel, in which case the gear wheel interacts with a toothed rack extending in the longitudinal direction of the transport rail. The deflection wheel interacts with a toothed belt extending in the longitudinal direction of the transport rail, on the toothed rack or on the toothed belt, a tapping point being formed in an area away from the transport rails. In the tapping point a coupling rod with an end piece is pivotally connected, the other end piece being pivotally connected with the transport rail.

However, it is a disadvantage of the known arrangement that the different movements of the transport rails are mechanically coupled which results in a relatively high-expenditure mounting of the entire arrangement and in a relatively large number of moved masses.

In modern presses, the driving devices for the individual moving directions of the transport rails are electrically coupled with one another, whereby a high-expenditure mechanical coupling is eliminated.

However, in such case, it is a disadvantage that the driving devices provided for the transverse movement of the transport rails simultaneously must also displace the driving devices provided on cross traverses for the movement of the transport rails in the longitudinal direction. This requires that the driving devices for the transverse movement of the transport rails must have a stronger design.

Another problem which occurs in this connection is a possible tilting of the cross traverses in their guide rails so that, as a result, no perfect and mainly no-jolt and therefore precise movement of the transport rails is ensured.

For this reason, additional transverse drives are provided which, synchronously with the driving motor for the horizontal movement of the transport rails which is arranged in a closing box of the press, move the cross traverses, on which the driving devices for the longitudinal movement of the transport rails are arranged, toward one another so that a tilting of the cross traverse in its guide rails is excluded.

However, because the transport rails in the horizontal plane may move simultaneously in two axial directions, this is, they move in a circle, the driving devices cannot be connected with the transport rails by way of simple coupling members, such as rods. Otherwise the coupling members would tilt or twist and very high tensions would occur in the material of the coupling members which may even lead to a destruction of the coupling members.

It is therefore an object of the present invention to provide an arrangement for transferring workpieces through a succession of machining stations of a press, a simulator or similar machining or tool-setting machine which avoids the described disadvantages of the prior art, particularly by way of which a linking of the driving motors to the transport rails is possible which presents no problems.

According to the invention, this object has been achieved by providing that between the transport rails and the motors for the horizontal movement of the transport rails arranged on the traverse, a compensating guide is provided which has at least two struts and a double-armed lug with three hinge points, each of the struts, on the traverse-side, being disposed in a hinged manner at one hinge point respectively, the other end of the struts each being mounted on one of the hinge points of the double-armed lug, and the third hinge point of the double-armed lug being mounted in hinged manner on the transport rail.

By providing such a compensating guide, a connection can be established in a simple manner between the transport rails and the motors for the horizontal movement of the transport rails arranged on the traverse so that a perfect operation of the transport rails is ensured which presents no problems.

The movement of the transport rails in a circle during a movement of the transport rails simultaneously in two axial directions is compensated by the described arrangement so that a tilting a twisting of the transport rails is excluded.

BRIEF DESCRIPTION OF THE DRAWINGS

These and other objects, features and advantages of the present invention will become more readily apparent from the following detailed description thereof when taken in conjunction with the accompanying drawings wherein:

FIG. 2 is a side view of a first embodiment of a compensating guide for the arrangement of FIG. 1;

FIG. 3 is a plan view of the compensating guide of FIG. 2;

DETAILED DESCRIPTION OF THE DRAWINGS

Figure 1:
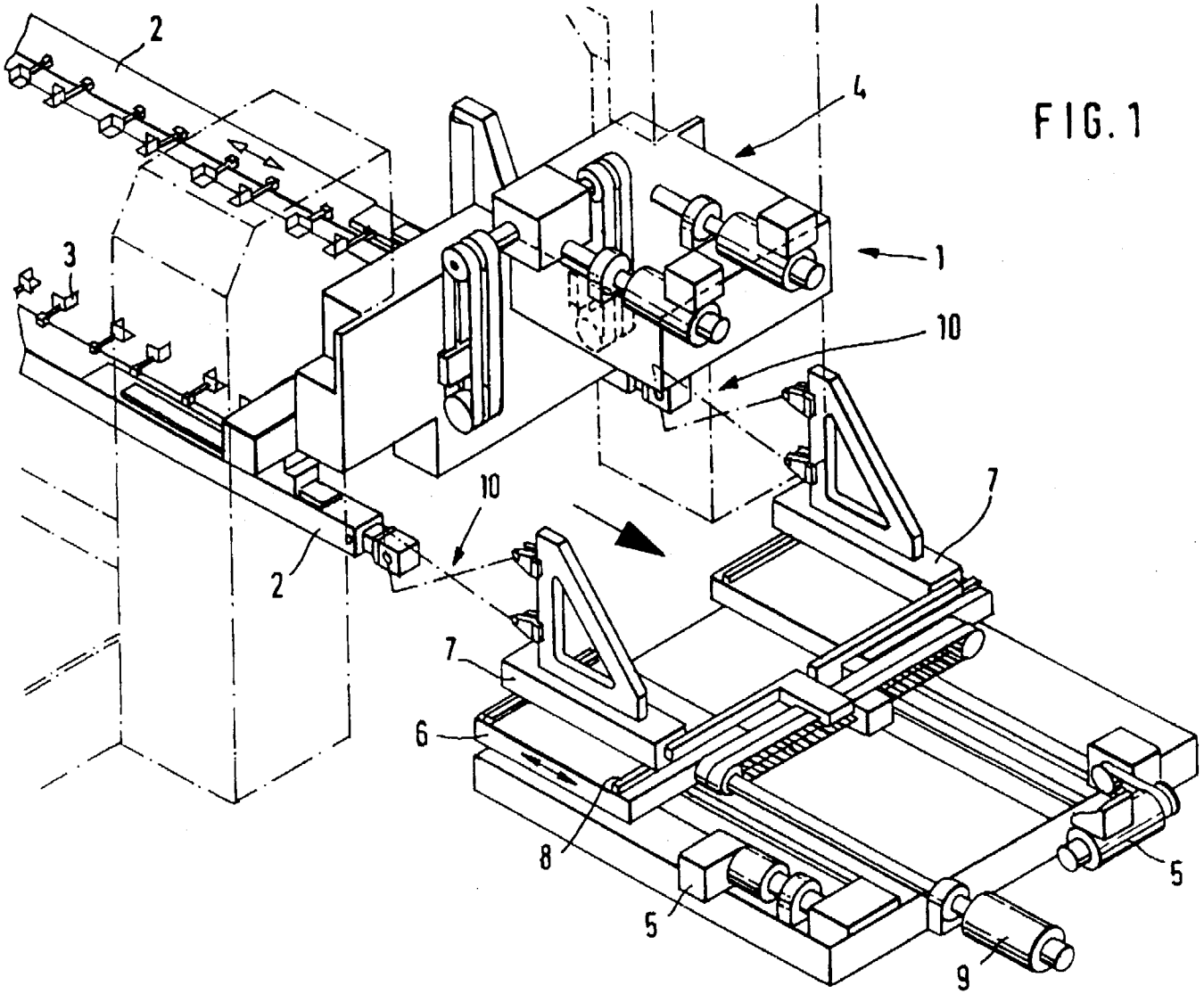
FIG. 1 is a three-dimensional view of a press which is provided with the arrangement according to the present invention.

In reference to FIG. 1, a press or a simulator 1 is shown which has transport rails 2 which can be moved into three axial directions which are situated perpendicularly upon one another. The passage direction of workpieces through the press 1 is indicated by an arrow.

Known grippers 3, such as tongs, suction devices or the like, are mounted on the transport rails 2.

In closing boxes 4 of the press 1, driving devices are arranged for movements of the transport rails 2 in the transverse direction, that is, toward one another in the horizontal direction, as well as for movements in the vertical direction.

The longitudinal movements of the transport rails 2 are carried out by driving devices 5 which move carriages 6 adapted to be slid in linear guides in parallel to the passage direction.

On the carriages 6, traverses 7 are arranged which can be slid in the transverse direction, that is, transversely to the passage direction and which are connected with the transport rails 2 by suitable devices described below.

In this case, the traverses 7 are disposed in linear guides 8. The traverses 7 are moved by an additional transverse drive 9 synchronously to the movement of the transport rails 2.

A connection between the traverses 7 and the transport rails 2 takes place by way of compensating guides 10 which are schematically illustrated in FIG. 1 and which are shown in detail in FIGS. 2 and 3. Each individual compensating guide has two struts 11, 12 which, on one side, are each hinged on the traverse side, thus on the side facing the traverse 7, by way of an upper hinge point, 15 and a lower hinge point 16, with the traverse 7 and, on the other side, are hinged by way of hinge points 17, 18 with a triangular double-armed lug 13, as illustrated in FIGS. 2 and 3.

The triangular double-armed lug 13, in turn, is provided on one end with a third hinge point 19 and is connected by way of a pin 14 in a hinged manner with the transport rail 2.

By virtue of the described arrangement, a compensating guide is implemented which avoids a tilting or twisting of the transport rails 2 and/or of the traverse 7.

In the present embodiment, it is provided that one triangular double-armed lug 13 respectively is provided laterally on each individual transport rail 2.

Of course, it is also possible to, in each case, provide only one triangular double-armed lug 13 with the corresponding struts 11, 12 per transport rail 2.

Figure 4:
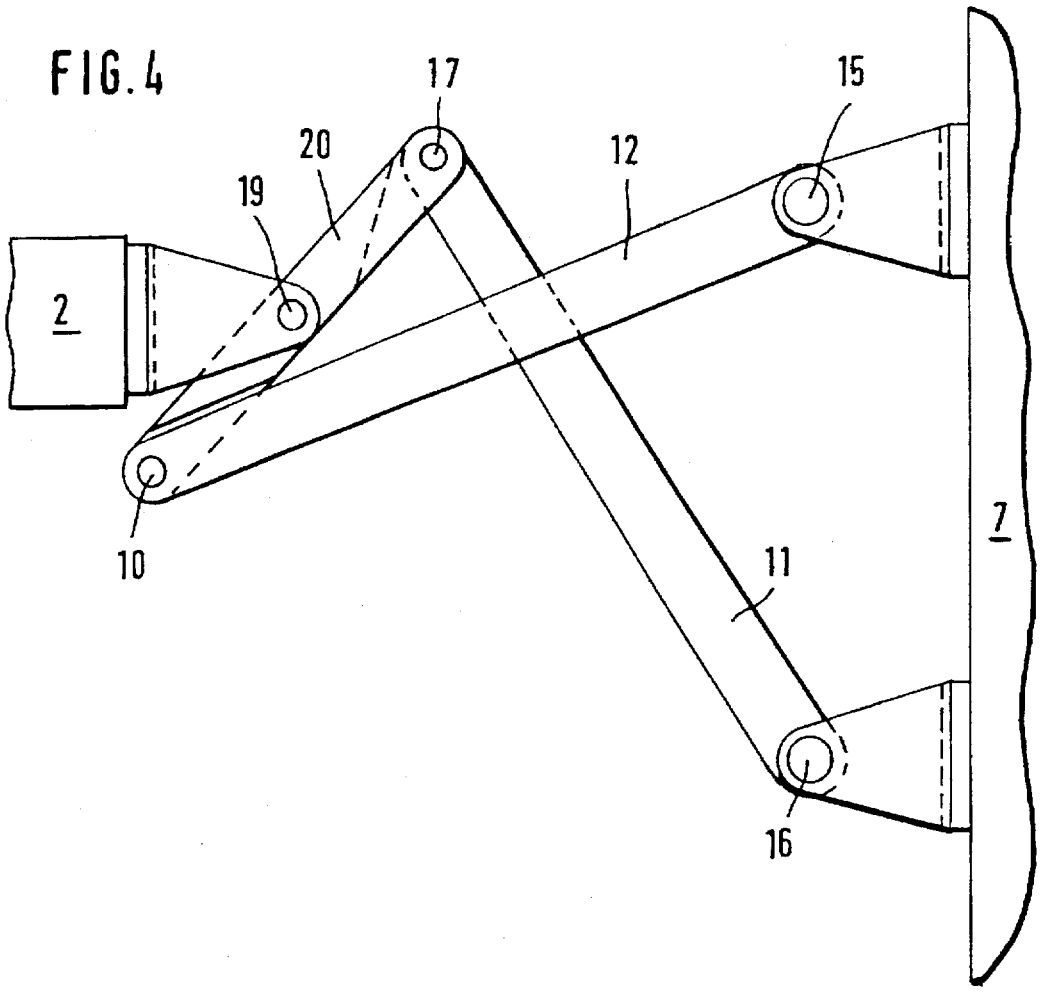
FIG. 4 is a side view of a second embodiment of a compensating guide.
Figure 5:
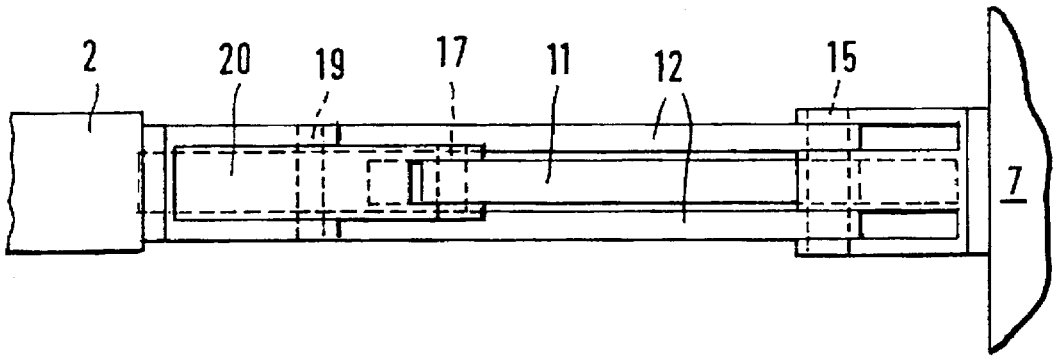
FIG. 5 is a plan view of the compensating guide of FIG. 4.

A second embodiment of a compensating guide is illustrated in FIGS. 4 and 5. Reference numbers introduced in conjunction with the description of the preceding figures will be used in the following for the same components.

Instead of a triangular double-armed lug, a straight double-armed lug 20 is used in this embodiment on whose ends, in the hinge points 17, 18, the respective struts 11 and 12 are disposed in a hinged manner while the ends of the struts 11 and 12 facing away from the transport rails 2 are connected by way of the upper hinge point 15 and the lower hinge point 16 in a hinged manner with the traverse 7.

The straight double-armed lug 20 itself is connected in the center by way of the third hinge point 19 in a hinged manner with the transport rail 2.

It should also be pointed out that the struts 11, 12 are arranged to be crossing one another. That is, on one side, the strut 11 is connected with the upper hinge point 17 of the straight double-armed lug 20 and, on the other side, it is connected with the lower hinge point 16 on the traverse 7, while the other strut 12 is hinged to the lower hinge point 18 of the straight double-armed lug 20 and to the upper hinge point 15 of the traverse 7.

Also by way of the arrangement described in the second embodiment the movement of the transport rails on a straight line or linearly can be implemented in a simple manner, in which case a twisting or tilting of the transport rails is, however, excluded.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. Arrangement for transferring workpieces through a succession of machining stations, comprising two spaced parallel transport rails, a traverse hingedly connectable with each of said rails, and motors for moving the transport rails, via each traverse, at least one of horizontally in a longitudinal direction thereof, and horizontally toward one another, wherein, between the transport rails and the motors for the horizontal movement of the transport rails arranged on the traverse, a compensating guide is provided which has at least two struts and a double-armed lug with three hinge points, each of the struts, on the traverse-side, being disposed in a hinged manner at one hinge point respectively, the other end of the struts each being mounted on one of the hinge points of the double-armed lug, and the third hinge point of the double-armed lug being mounted in hinged manner on the transport rail.

2. Arrangement according to claim 1, wherein the double-armed lug is a triangular lug.

3. Arrangement according to claim 1, wherein the double-armed lug is a straight lug.

* * * * *